US009048003B2

(12) United States Patent
Johnsen et al.

(10) Patent No.: US 9,048,003 B2
(45) Date of Patent: Jun. 2, 2015

(54) SELF-SUPPORTING CABLE

(75) Inventors: Ulf Fridtjof Johnsen, Falun (SE); Lars Efraimsson, Falun (SE)

(73) Assignee: NKT CABLES GROUP A/S, Brondby (DK)

( * ) Notice: Subject to any disclaimer, the term of this patent is extended or adjusted under 35 U.S.C. 154(b) by 332 days.

(21) Appl. No.: 13/805,045

(22) PCT Filed: Jul. 6, 2010

(86) PCT No.: PCT/SE2010/050789

§ 371 (c)(1),
(2), (4) Date: Apr. 3, 2013

(87) PCT Pub. No.: WO2012/005641

PCT Pub. Date: Jan. 12, 2012

(65) Prior Publication Data

US 2013/0180753 A1 Jul. 18, 2013

(51) Int. Cl.
*H01B 7/18* (2006.01)
*H01B 9/00* (2006.01)

(52) U.S. Cl.
CPC ..... *H01B 9/008* (2013.01); *H01B 7/188* (2013.01)

(58) Field of Classification Search
USPC ..... 174/102 R, 105 R, 105 SC, 102 SC, 103, 174/106, 107, 109, 110 R, 112
See application file for complete search history.

(56) References Cited

U.S. PATENT DOCUMENTS

| | | | | |
|---|---|---|---|---|
| 4,378,462 | A * | 3/1983 | Arnold et al. | 174/70 A |
| 4,956,523 | A | 9/1990 | Pawluk | |
| 5,527,995 | A * | 6/1996 | Lasky | 174/102 SC |
| 6,288,339 | B1 * | 9/2001 | Efraimsson et al. | 174/102 R |

(Continued)

FOREIGN PATENT DOCUMENTS

| | | | |
|---|---|---|---|
| CN | 1216630 | A | 5/1999 |
| CN | 101504877 | A | 8/2009 |
| EP | 0 177 475 | A2 | 4/1986 |

(Continued)

OTHER PUBLICATIONS

International Search Report, Application No. PCT/SE2010/050789, Feb. 15, 2011.

(Continued)

*Primary Examiner* — William H Mayo, III
(74) *Attorney, Agent, or Firm* — Buchanan Ingersoll & Rooney PC

(57) ABSTRACT

The current invention relates to self-supporting cables that often are aerial mounted between cable fixing points (800) and where the conductors in the cables act as the bearing elements. In this type of cables, slippage between the surfaces of different layers in the cable is undesirable. On the other hand, it must be possible to easily bend the cable, even for larger dimensions. Both these requirements are difficult to meet with the solutions from prior art. The present invention overcomes this by introducing an intermediate layer (130) between the surfaces (112, 121) comprising at least on tape (511) with friction particles (512) where the friction obtained by the friction particles (512) is low enough to allow the two surfaces (112, 121) to slip relatively each other in longitudinal direction enough so that the cable 100 can be bent but prevents the two surfaces (112, 121) from slipping in response to an inwardly directed radial pressure force (F) at the cable fixing points (800).

13 Claims, 8 Drawing Sheets

(56) References Cited

U.S. PATENT DOCUMENTS

| | | | | |
|---|---|---|---|---|
| 7,166,802 | B2 * | 1/2007 | Cusson et al. | 174/113 R |
| 8,669,474 | B2 * | 3/2014 | Battle et al. | 174/113 R |

FOREIGN PATENT DOCUMENTS

| | | | |
|---|---|---|---|
| EP | 0 461 794 | A1 | 12/1991 |
| WO | 97/40504 | A1 | 10/1997 |

OTHER PUBLICATIONS

Ericsson AB, "N1XE 1kV Produktinformation", 8/287 01-FGC 101 680 Rev G, 2009, 2 pp.
Ericsson AB, "AXCES 12/20(24) kV 3×95/25 Produktinformation", 4/287 01-FGC 101 683 Rev F, 2009, 2 pp.
Office Action issued on Nov. 2, 2014, by the Chinese Patent Office in corresponding Chinese Patent Application No. 201080067921.X and an English Translation of the Office Action. (12 pages).

* cited by examiner

SELF-SUPPORTING CABLE

CROSS REFERENCE TO RELATED APPLICATION

This application is a 35 U.S.C. §371 national stage application of PCT International Application No. PCT/SE2010/050789, filed on 6 Jul. 2010, the disclosure and content of which is incorporated by reference herein in its entirety. The above-referenced PCT International Application was published in the English language as International Publication No. WO 2012/005641 A1 on 12 Jan. 2012.

TECHNICAL FIELD

The present invention relates to a self-supporting cable.

BACKGROUND

It is known from prior art to make aerial cables self-supporting by using separate supporting elements. These could for example be a separate messenger wire of steel. This wire could be mounted along the cable as illustrated in the European patent EP0461794. The cable could also be twisted around the messenger wire in a spiral.

It is also known to provide cables of improved tensile strength by embedding supporting elements in the cable insulation as described in U.S. Pat. No. 4,956,523.

A disadvantage of using these supporting elements is that the cables become expensive to produce. A cable with a supporting element also becomes heavier and for steel messengers there is often a demand that the messenger wire should be grounded for safety reasons which complicates the mounting in cable fixing points.

An electrical cable comprises one or several conductors that are made out of aluminum or copper. One solution is therefore to let the conductor itself act as the supporting element.

The conductors are normally surrounded by a plurality of different layers or shields, conductor shields, insulation shields, screen etc. If the different layers and/or conductors within the cable are not adhered to each other it becomes easy to bend the cable as the layers/conductors can stretch and slip relatively each other. This slippage is however undesirable for self-supporting cables. To overcome the slippage an inwardly directed radial pressure force to the cable in the cable fixing points can be applied so that the slippage is avoided. This force needs however to be very strong and has the disadvantage of damaging the outermost layers of the cable.

A solution to avoid the slippage is to simply make the different layers/conductors adhere to each other (for example by gluing or melting). This has however the disadvantage that the cable will become difficult to bend and it will also be very difficult to separate the different layers/conductors from each other without damaging the cable when jointing or terminating.

In U.S. Pat. No. 6,288,339 layers with undulations are disclosed. This solution has the effect that the layers can slip relative each other to some extent when the cable is bent, but in response to a relatively low inwardly directed radial pressure force the undulated layers cam into each other whereby the slippage is avoided. However, the flexibility becomes somewhat limited for large dimension cables.

SUMMARY

It is the object of the invention to obviate at least some of the above disadvantages and to provide an improved self-supporting cable.

The problems and disadvantages are in the invention solved by an intermediate portion in the cable positioned between the outer surface of an inner portion (e.g. a core with conductors) and the inner surface of an outer portion (e.g. a shield and/or a sheath) and where the intermediate portion comprises at least one tape made of a non-woven material and comprising friction particles adhered to at least one side of the tape and where the friction between the friction particles and any of the two surfaces is allowing the two surfaces to slip relatively each other in longitudinal direction enough so that the cable can be bent but prevents the two surfaces from slipping in response to an inwardly directed radial pressure force at cable fixing points.

The tension forces and the gravitational force acting on the cable between said fixing points can now be transmitted into the conductors and the cable will become self-supporting.

As an option, the intermediate portion is further arranged so that in response to an outwardly directed radial force applied to the outer portion, the outer portion can easily be separated from the inner portion.

An advantage with the invention is that the cable is both easy to bend and can be mounted in cable fixing points such as dead end spirals without slippage between the layers. This applies also to large diameter cables.

Another advantage is that the orientation of the structure of the intermediate portion is not critical which makes the cable easier and less expensive to produce.

Yet another advantage is that the intermediate portion also reduces vibrations and oscillations when the cable is subject to strong winds.

The invention will now be described in more detail and with preferred embodiments and referring to accompanying drawings.

DETAILED DESCRIPTION

Figure 1A:
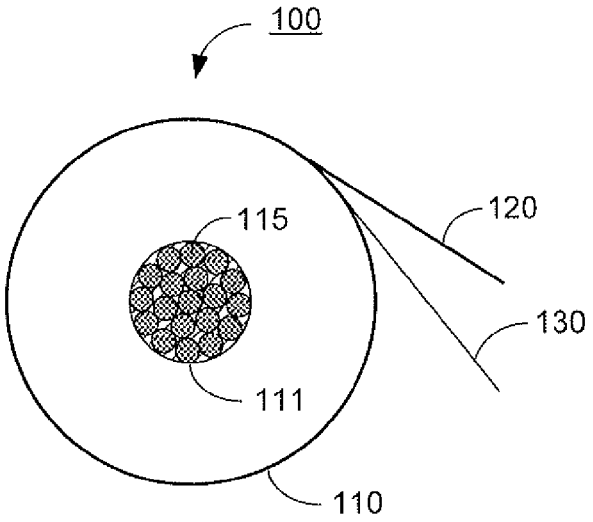
FIGS. 1*a* and 1*b* are block diagrams illustrating a radial and a longitudinal cross section of one embodiment of a cable according to the invention.
Figure 1B:
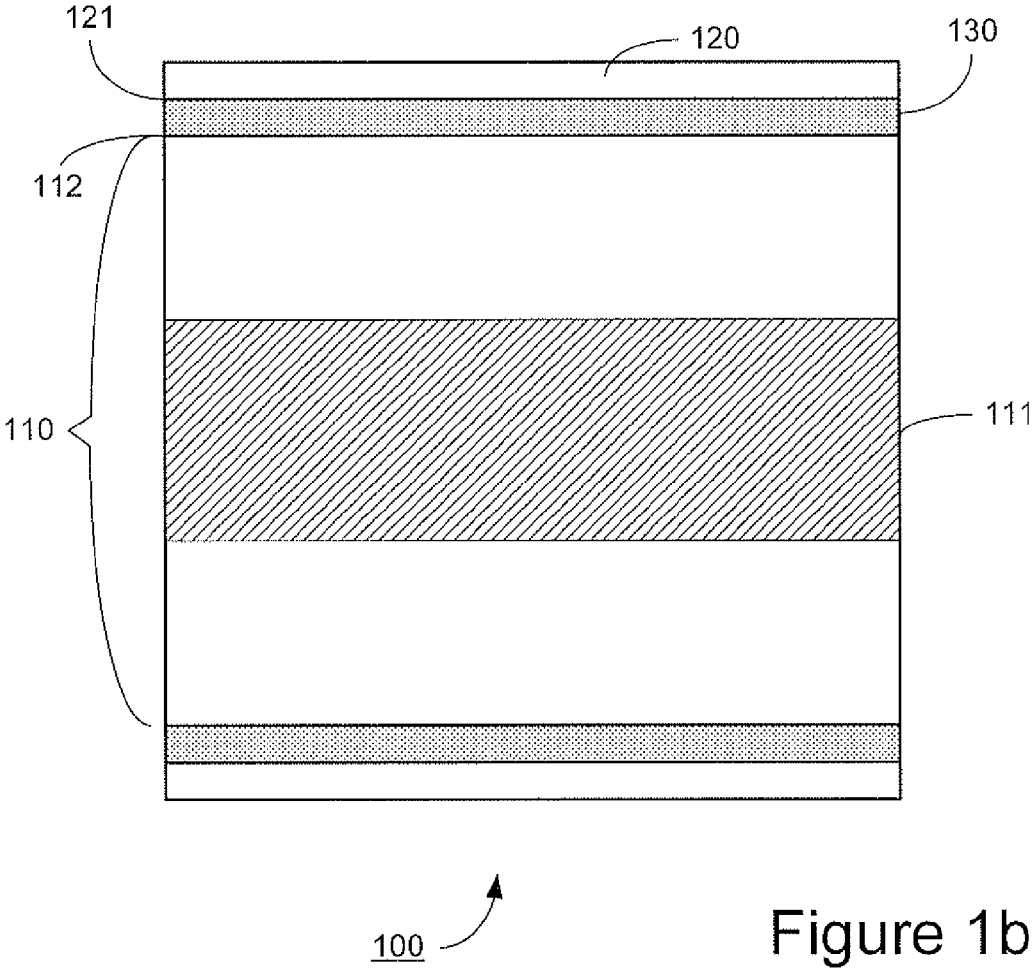
Figure 2:
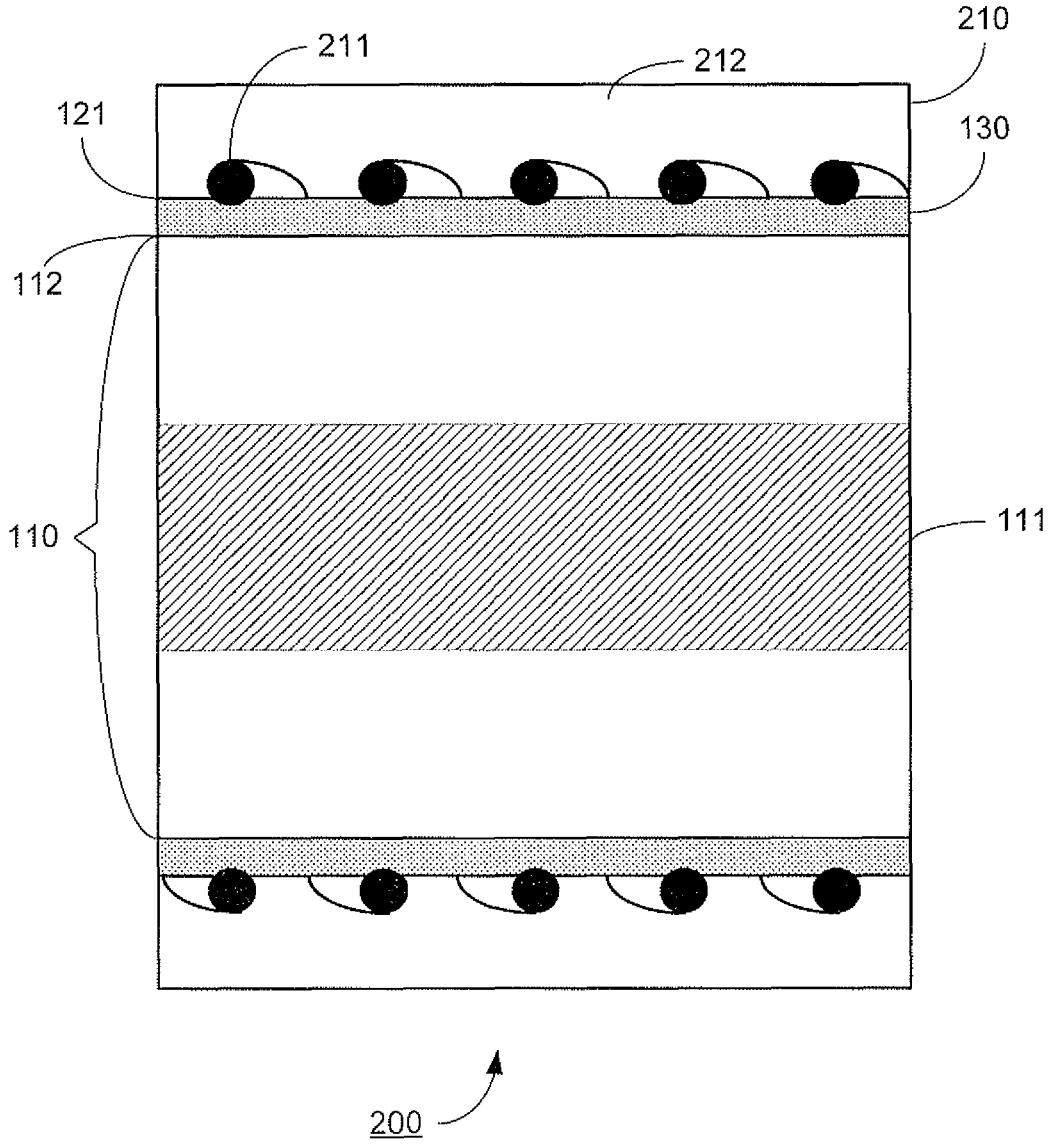
FIGS. 2 and 3 are block diagrams illustrating a longitudinal cross section of two additional embodiments of a cable according to the invention.

FIGS. 1*a* and 1*b* illustrates a radial and a longitudinal cross-section of a cable 100 according to the present invention. The cable 100 in FIGS. 1*a* and 1*b* comprises an inner portion 110 with an outer surface 112, an outer portion 120 with an inner surface 121 and an intermediate portion 130. The inner portion 110 comprises one or several conductors 111. Each conductor 111 often consists of a plurality of metal wires 115 (normally aluminum or copper). The inner portion 110 and the outer portion 120 can consist of one or several layers of different types, plastic isolating layer, metal shield, semi conductive shield, sheath etc. An example on a cable 200 with an outer portion 210 comprising a metal shield 211 and a plastic layer 212 is illustrated in FIG. 2. The plastic layer 212 has penetrated between the wires of the metal shield 211 by melting in the extrusion process.

Figure 3:
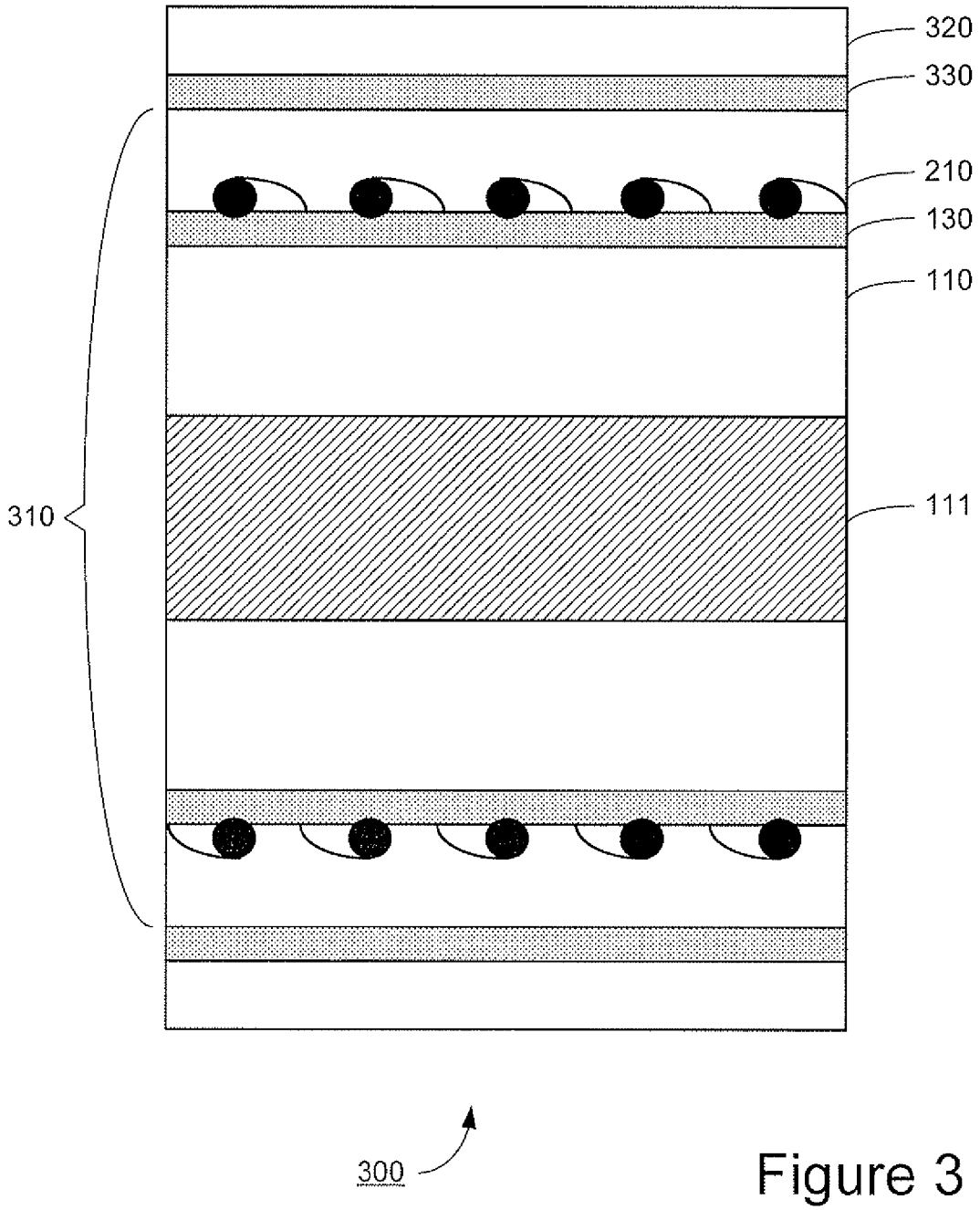

The embodiments of the invention illustrated by FIGS. 1*a*, 1*b* and 2 comprise only one intermediate portion 130. The inventive concept is however not limited to one intermediate portion 130 only but several intermediate portions can be used. This is illustrated in FIG. 3. What in FIG. 2 comprises a cable 200 with an outer portion 210 can in principle be regarded as the inner portion 310 of a cable 300 with yet another intermediate portion 330 and yet another outer portion 320.

Figures 4A, 4B:
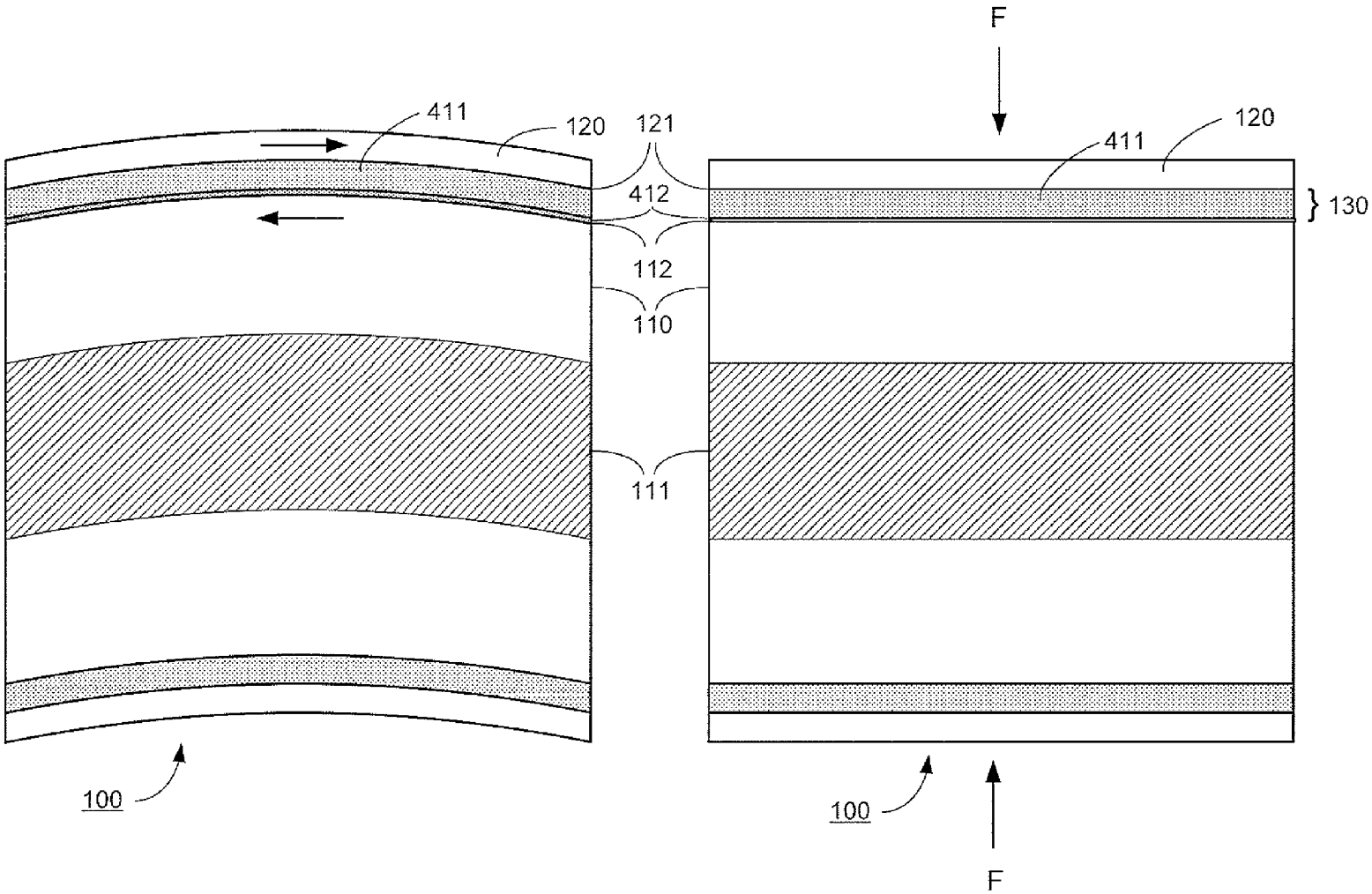
FIGS. 4*a* and 4*b* are block diagrams illustrating a bent cable and a cable subject to an inwardly directed radial pressure force.

The main principle of the invention is for example illustrated in FIGS. 4*a* and 4*b*. The intermediate portion 130 comprises a tape 411 with friction particles 412 on one of its sides. In FIGS. 4*a* and 4*b* the tape 411 is adhered to the surface 121 and the side with the friction particles 412 is facing the other surface 112. The friction between the friction particles 412 and the surface 112 is allowing the two surfaces 112, 121 to slip relatively each other in longitudinal direction enough so that the cable 100 can be bent (FIG. 4*a*) but prevents the two surfaces 112, 121 from slipping in response to an inwardly directed radial pressure force F at cable fixing points (FIG. 4*b*). The tension forces and the gravitational force acting on the cable 100 between said fixing points can be transmitted into the conductors 111 and the cable 100 will become self-supporting.

Figure 5A:
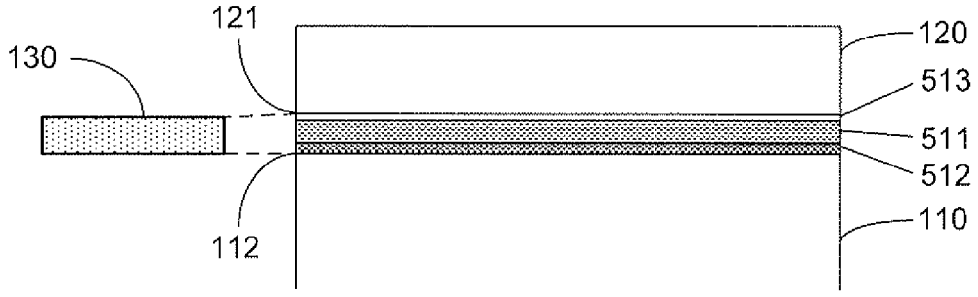
FIGS. 5*a*, 5*b* and 5*c* are block diagrams illustrating three embodiments of the intermediate portion.
Figure 5B:
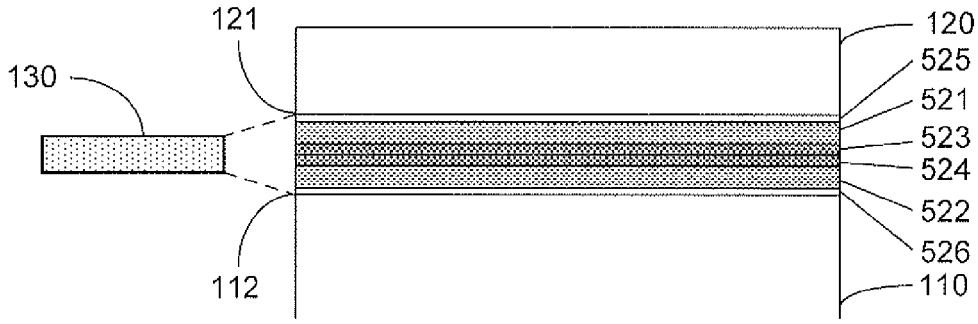
Figure 5C:
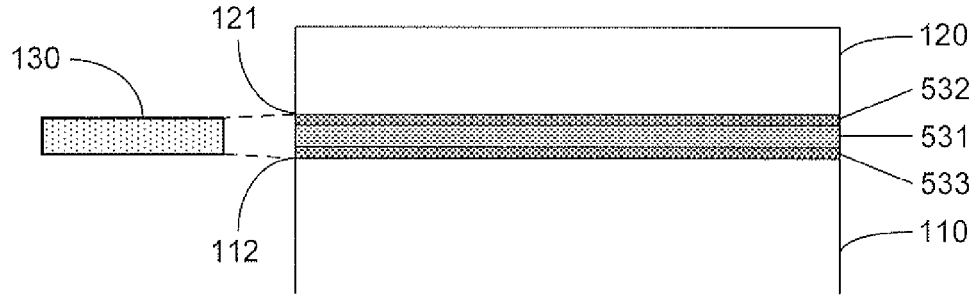

Three embodiments of the invention are illustrated in FIGS. 5*a*, 5*b* and 5*c*.

In a preferred embodiment illustrated in FIG. 5*a* the intermediate portion 130 comprises a tape 511 adhered to the inner surface 121 of the outer portion 120. On the tape 511 friction particles 512 are adhered to the side facing the outer surface 112 of the inner portion 110. The friction particles 512 are preferably sand-blasting sand that has been glued to the tape 511. Optionally, the band 511 is adhered to the surface 121 by using an adhering tape 513 that has become adhesive on both sides in response to heating above a predetermined temperature (for example during the extrusion process of the outer portion 120). In FIG. 5*a* the friction is between the friction particles 512 and the outer surface 112 of the inner portion 110.

The same technical effect is obtained if the band 511 is adhered to the outer surface 112 of the inner portion 110 instead and where the friction particle 512 are adhered to the side of the band 511 facing the inner surface 121 of the outer portion 120.

In FIG. 5*b* the intermediate portion 130 comprises a first tape 521 adhered to the inner surface 121 of the outer portion 120 and a second tape 522 adhered to the outer surface 112 of the inner portion 110. Friction particles 523, 524 are adhered to the sides of the tapes 521, 522 facing each other. Similar as in FIG. 5*a* the friction particles 523, 524 are preferably sand-blasting sand that has been glued to the tapes 521, 522. The tapes 521, 522 are optionally adhered to the surfaces 121, 112 using adhering tapes 525, 526. In FIG. 5*b* the friction is between the two sides with friction particles 523, 524 that are facing each other.

In FIG. 5*c* the intermediate portion 130 comprises a single tape 531 that is not adhered to any of the surfaces 112, 121. Instead, friction particles 532, 533 are adhered to both sides of the tape 531. Here the friction is between the two sides with friction particles 532, 533 and the two surfaces 112, 121.

Again, the friction is low enough to allow the two surfaces 112, 121 to slip relatively each other in longitudinal direction enough so that the cable 100 can be bent but prevents the two surfaces 112, 121 from slipping in response to the inwardly directed radial pressure force (F).

Figure 6:
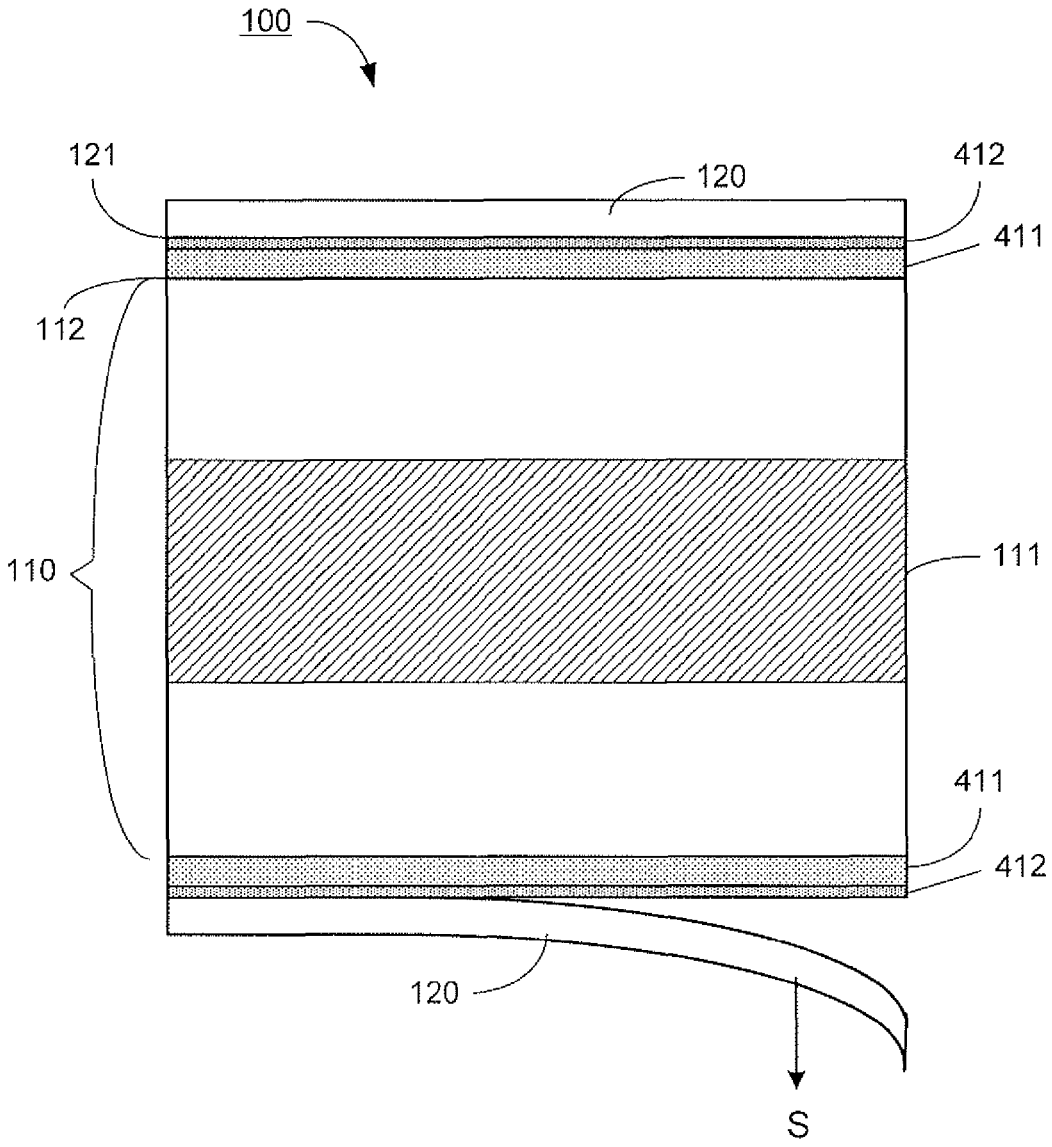
FIG. 6 is a block diagram illustrating a longitudinal cross section of a cable according to the invention with a separated outer portion.

The band 411 with friction particles 412 further allows the outer portion 120 to be easily separated from the inner portion 110 by applying an outwardly directed radial force S to the outer portion 120. This is illustrated in FIG. 6.

Yet another feature of the invention is that the intermediate portion 130 also reduces vibrations and oscillations of the cable 100. Vibrations and oscillations can occur when the cable 100 is subject to strong winds and can cause the cable 100 to come loose from its fixing points. The frictional structure of the intermediate portion 130 reduces the vibrations and oscillations as it transforms the kinetic energy from the relative movement between the two surfaces 112, 121 to thermal energy (heat) due to the friction.

Although the FIGS. 1 to 6 only illustrate cables with one conductor 111, the inner portion 110 of the cable 100 can comprise a plurality of conductors. Two examples of this are illustrated in FIGS. 7*a* and 7*b*.

Figure 7A:
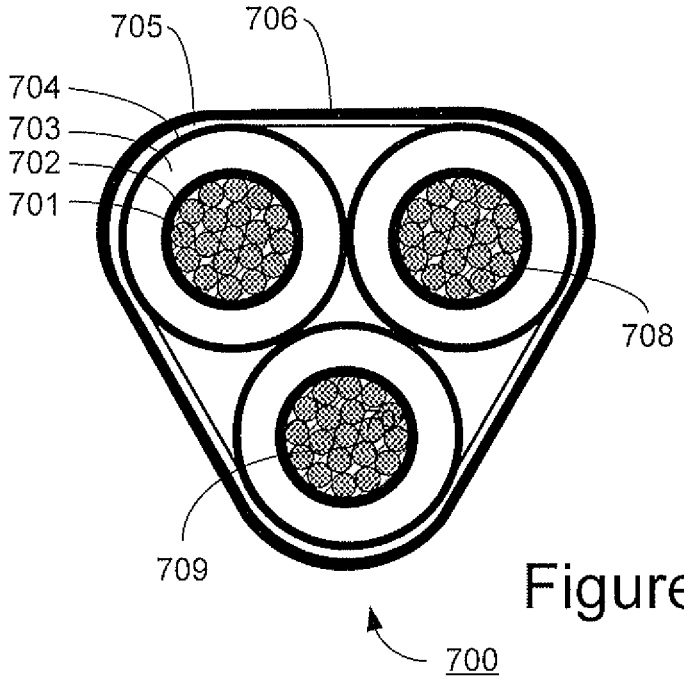
FIG. 7*a* is a block diagram illustrating a 3-core high voltage power cable comprising the present invention.

The cable 700 in FIG. 7*a* is a high voltage AXCES type of cable for 12 kV where the inner portion comprises three conductors 701, 708, 709 made of aluminum. Around each conductor 701 an inner conductive layer 702 of polyethylene, PE is extruded. Around the inner conductive layer 702 an insulation layer 703 of cross-linked polyethylene, PEX or XLPE is triple extruded. Around the insulation layer 703 a second conductive polyethylene layer 704 is extruded.

Around this inner portion, comprising the three conductors 701, 708, 709 each with its conductive and insulating layers 702,703,704, the intermediate portion 705 is mounted. For high-voltage cables, the intermediate portion 705 can be conducting. The outer portion comprises screen wires or foil normally of copper or aluminum (not shown) wrapped around the intermediate portion 705. Finally, a black LLD PE (linear low density polyethylene) sheath 706 is extruded over the screen.

Figure 7B:
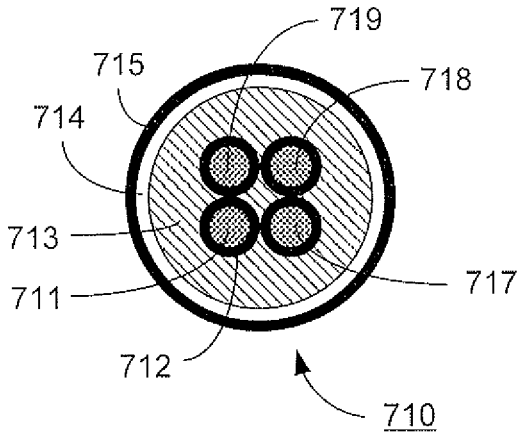
FIG. 7*b* is a block diagram illustrating a 1 kV power cable comprising the present invention.

The cable 710 in FIG. 7*b* is a N1XE type of cable for 1 kV with four conductors 711, 717, 718, 719. As this cable 710 is made for lower voltage the dimensions of the conductors 711, 717, 718, 719 are smaller. The four conductors 711, 717, 718, 719 can for example be of solid round copper (as in FIG. 7*b*), stranded round copper or of stranded sector shaped aluminum depending on cross section area. In this cable 710, the inner portion comprises the four conductors 711, 717, 718, 719 each having an insulation layer 712 of cross-linked polyethylene. Around the four conductors 711, 717, 718, 719 an inner covering 713 is extruded. Around this inner covering 713 the intermediate portion 714 is mounted and the outer portion of the cable comprises a black polyethylene sheath 715 extruded over the intermediate portion 714.

Figure 8:
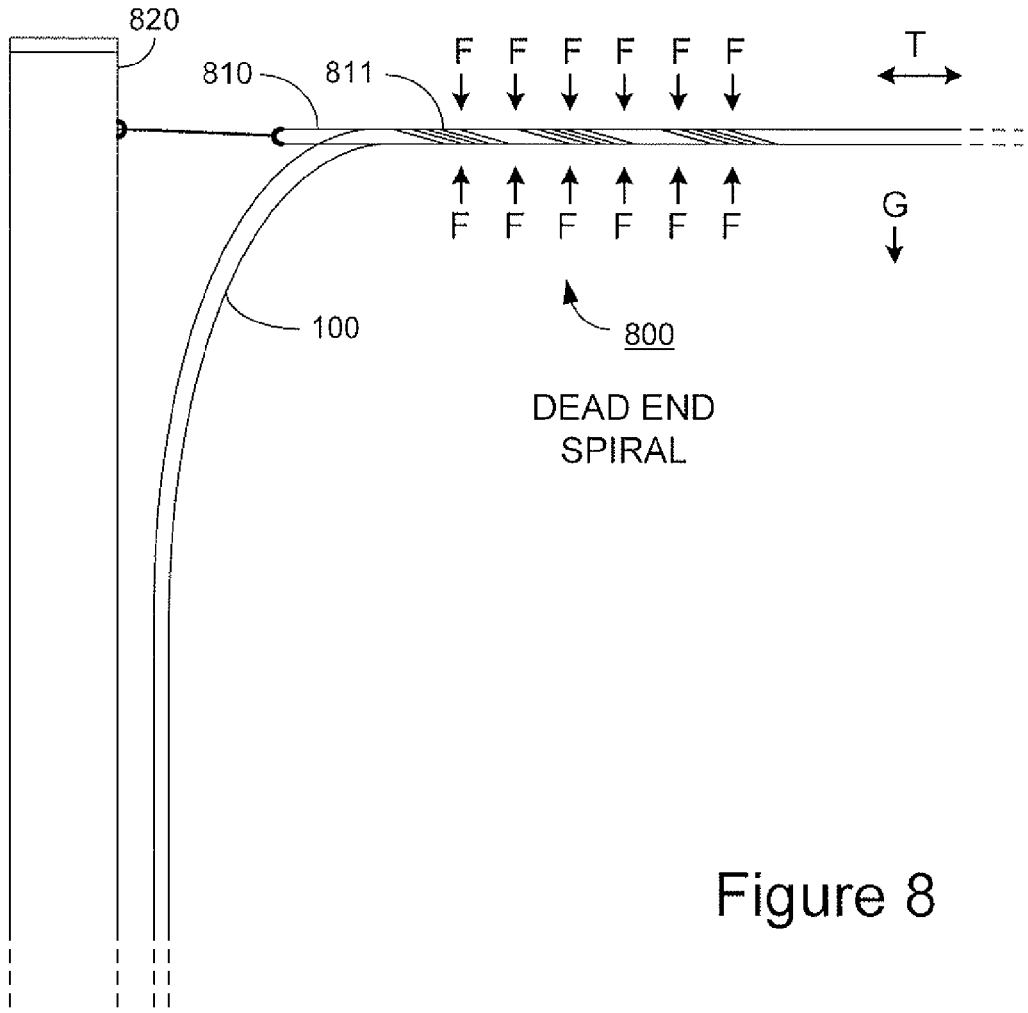
FIG. 8 is a block diagram illustrating a cable fixing point.

An example of a cable fixing point used for self-supporting cables is a so called dead end spiral. An example of a dead end spiral is illustrated in FIG. 8. In the fixing point 800, a metal wire 810 is twisted around the cable 100 in a spiral 811. The other end of the wire 810 is fixed to a pole 820. In order to not damage the outer layers of the cable 100 in the fixing point 800, the radial pressure forces F applied to the cable 100 must be relatively low. Therefore the spiral 811 extends up to two meters along the cable in order to distribute the radial pressure forces F to the cable. By applying relatively weak forces F to a cable 100 according to the present invention, tension forces T and the gravitational force G acting on the cable 100 are transmitted into the conductors 111 without slippage between the layers in the cable 100.

Although the embodiments described above mainly address electrical cables, the inventive concept can also be used for optical cables having an inner portion with a sufficient mechanical strength that allows the cable to be self-supporting.

The invention claimed is:

1. A self-supporting cable comprising:

an inner portion comprising at least one conductor;

an outer portion;

an intermediate portion positioned between the outer surface of the inner portion and the inner surface of the outer portion and where the intermediate portion comprises at least one tape made of a non-woven material and comprising friction particles adhered to at least one side of the tape and where the friction between the friction particles and any of the two surfaces is allowing the two surfaces to slip relatively each other in longitudinal direction enough so that the cable can be bent but prevents the two surfaces from slipping in response to an inwardly directed radial pressure force at cable fixing points so that tension forces and the gravitational force acting on the cable between said fixing points can be transmitted into the conductors wherewith the cable becomes self-supporting by virtue of the intrinsic mechanical strength of the conductors.

2. A cable as in claim 1 where the intermediate portion comprises a first tape with friction particles and adhered to one of the two surfaces and where the side with the friction particles is facing the other surface.

3. A cable as in claim 1 where the intermediate portion comprises a first tape with friction particles and adhered to the outer surface of the inner portion and a second tape with friction particles and adhered to the inner surface of the outer portion, and where the sides with the friction particles are facing each other.

4. A cable as in claim 1 where the tape is adhered to the surface by an adhering tape that has become adhesive on both sides in response to heating above a predetermined temperature.

5. A cable as in claim 1 where the intermediate portion comprises a tape having friction particles adhered to both sides of the tape.

6. A cable as in claim 1 where the friction particles consist of sand-blasting sand that has been adhered to the tape by gluing.

7. A cable as in claim 1 where the structure of the intermediate portion is further arranged so that in response to an outwardly directed radial force applied to the outer portion, the outer portion can be easily separated from the inner portion.

8. A cable as in claim 1 where the frictional structure of the intermediate portion is adapted to transform kinetic energy to thermal energy when the two surfaces move relative each other.

9. A cable as in claim 1 being an electrical cable and where the conductors comprise at least one metal wire.

10. A cable as in claim 1, where the friction particles consist of sand particles adhered by glue to the tape.

11. A cable as in claim 2, where the friction particles consist of sand particles adhered by glue to the tape.

12. A cable as in claim 3, where the friction particles consist of sand particles adhered by glue to the tape.

13. A cable as in claim 1, where the friction particles consist of sand particles adhered by glue to both sides of the tape.

* * * * *